US006167988B1

(12) United States Patent
Frodge et al.

(10) Patent No.: US 6,167,988 B1
(45) Date of Patent: Jan. 2, 2001

(54) LINEMAN'S LADDER STABILIZER

(75) Inventors: David Bruce Frodge, Lexington, KY (US); James Vogt, St. Paul, MO (US)

(73) Assignee: Moore Diversified Products, Lexington, KY (US)

( * ) Notice: Under 35 U.S.C. 154(b), the term of this patent shall be extended for 0 days.

(21) Appl. No.: 09/360,132

(22) Filed: Jul. 23, 1999

(51) Int. Cl.[7] ..... E06C 7/00
(52) U.S. Cl. ..... 182/107; 182/206; 182/129
(58) Field of Search ..... 182/107, 206, 182/129; 248/218.4, 219.1, 230.1; 174/40 R

(56) References Cited

U.S. PATENT DOCUMENTS

| | | | | |
|---|---|---|---|---|
| 400,008 | | 3/1889 | Rasor . | |
| 631,302 | | 8/1899 | Harper . | |
| 1,042,192 | | 10/1912 | Doilot . | |
| 1,521,457 | * | 12/1924 | Lucas | 248/218.4 |
| 1,682,693 | * | 8/1928 | Day | 248/230.1 |
| 2,114,876 | * | 4/1938 | Forbes | 248/219.1 |
| 2,432,189 | | 12/1947 | Bucher et al. . | |
| 2,541,434 | | 2/1951 | Nelson et al. . | |
| 3,196,980 | * | 7/1965 | Rorden | 182/93 |
| 3,239,183 | * | 3/1966 | Price | 248/218.4 |
| 3,792,756 | | 2/1974 | Kelly . | |
| 4,296,904 | * | 10/1981 | Farmer | 248/218.4 |
| 4,379,498 | | 4/1983 | Krusmark | 182/107 |
| 4,440,263 | | 4/1984 | Smith | 182/121 |
| 4,665,279 | * | 5/1987 | Ruschkofski | 248/219.1 |
| 4,823,911 | | 4/1989 | Dore | 182/119 |
| 5,087,002 | * | 2/1992 | Okura | 248/218.4 |

* cited by examiner

*Primary Examiner*—Alvin Chin-Shue
(74) *Attorney, Agent, or Firm*—Lawrence R. Letson

(57) ABSTRACT

A horizontal support member in the form of rod, pipe or tube is disposed transverse to and displaced from a rigid or utility pole proximate a messenger cable supporting a cable. The support member is supported on and a part of a projecting arm extending outwardly from a bracket attached to the utility pole. The support member is further provided with flanges on the ends thereof to prevent hooks on the end of a lineman's ladder from slipping off the ends of the support member. The support member is long enough not only to provide engagement for both hooks of the lineman's ladder but also could be extended so that the ladder hooks cannot slide off the support member as long as the hooks of the lineman's ladder are astraddle the projecting arm. The projecting arm is of sufficient length to position the top of the ladder below the front face of an electrical equipment cabinet which may be hung on and bolted to a pole bracket. The positioning of the ladder thus further places a lineman at a convenient and comfortable working position relative to an electrical equipment cabinet or other apparatus that may be attached to the pole or to the pole bracket. The pole bracket is also useful to attach the invention to a wall, tower or trestle or other structure.

16 Claims, 4 Drawing Sheets

LINEMAN'S LADDER STABILIZER

FIELD OF THE INVENTION

This invention relates to ladder stabilizers and more specifically to a stabilizer for a lineman's ladder which will position a workman at a comfortable and efficient working distance from utility pole mounted devices, including electrical equipment cabinets, and moreover will complete a four-point support for the lineman's ladder, thereby improving stability and safety.

BACKGROUND OF THE INVENTION

In order to understand the prior practices and techniques to access and service utility pole mounted equipment cabinets it is best to refer to FIG. 1. Ladder 10 is illustrated engaging a messenger cable 12 that is supported on a utility pole 14. Aerially installed telephone cable 16 typically is supported or suspended on a utility pole 14 by a messenger cable 12.

Similarly, aerially installed cable television cable 20 is suspended on utility pole 14, and messenger cable 12 provides the support for the television cable 20.

Typically, the messenger cable 12 is attached to the utility pole 14 by a clamp 22 or equivalent which, in turn, is bolted to utility pole 14. The telephone or cable television cable 16, 20 then is lashed to the messenger cable 12 with lashing wire 24.

Telephone linemen and cable television linemen have used a ladder which has become known as a telephone lineman's or lineman's ladder 10. The ladder 10 comprises a pair of parallel side rails 26 and a plurality of rungs 28 transverse to and joining the rails 26.

At one end of side rails 26 of ladder 10, a pair of hooks 30 are installed on and attached, extending beyond the end of the rails 26. The hooks 30 may be used to hook over a messenger cable 12 to support the ladder 10, either at a utility pole 14 or at a mid-span location between utility poles 14; thus the upper end of ladder 10 hangs on and is supported from the messenger cable 12. This engagement prevents the upper end of the ladder 10 from sliding off the messenger cable 12 and creates a four-point support for the ladder 10.

The hooks 30 are a major contributing factor in stabilizing the lineman's ladder 10. Previously, such a ladder 10 could be leaned against a pole or the messenger cable creating an unstable three-point support for the ladder 10 leaning against the utility pole 14 or a four-point support at a pole 14 or at a mid-span location that is exposed to the ladder 10 shifting or slipping laterally relative to the messenger cable 12 under the weight of the lineman, and possibly collapsing. The use of the hooks 30 permits a lineman to ascend the ladder 10 and be positioned at a reasonably comfortable working distance from the messenger cable 12 and the telephone/cable television cables 16, 20 when standing on a rung high enough to place the cables 12, 16, 20 approximately chest high.

However, when an electrical equipment cabinet 50 or box 50 is installed on a utility pole 14 as shown in FIG. 2, the lineman's ladder 10 is positioned too far under cabinet 50 for the lineman to be able to work within cabinet 50 comfortably and safely. Electrical equipment cabinet 50 typically contains electronic equipment such as repeaters, amplifiers, fiber-optic cable-to-copper cable converters, all of which must be protected from the elements and which must be serviced from time to time. Typically, access to the equipment within cabinet 50 is through the front face 52 by opening doors 54. Sufficient room between the lineman and the cabinet 50 must be allowed to open the doors 54 without the lineman having to avoid the swinging of door 54 and possibly losing his balance.

Efforts to stabilize ladders relative to utility poles or trees have been made in the past. Examples of the these efforts include: U.S. Pat. Nos. 631,302; 2,432,189; 3,792,756; 4,379,498; 4,440,263; and 4,823,911.

U.S. Pat. No. 631,302 discloses an attaching device for attaching and supporting a ladder on a telephone pole. The ladder is disposed parallel to the pole and relies on a pole grip and a clamp to attach the ladder. The parallel position of the ladder relative to the utility pole creates a rise substantially vertically relative to the ground. The ladder's vertical orientation makes working from it without a safety belt extremely difficult, and working within a pole mounted equipment cabinet becomes virtually impossible.

U.S. Pat. No. 2,432,189 discloses a bracket attached to the rungs of a ladder to engage a sloping roof surface to cause the ladder to stand-off from the eaves of the roof, preventing damage to the eave parts.

U.S. Pat. No. 3,792,756 discloses a safety strap arrangement to encircle a utility pole, thereby preventing slippage of the ladder in a lateral direction and attempting to stabilize a three-point support for the ladder. This arrangement fails to address the possibility of a ladder pivoting about the single point of support on the pole and causing the person on the ladder to be shifted and fall off the ladder.

U.S. Pat. No. 4,379,498 describes a safety device for a ladder comprising a partially cylindrical member attached to a rung or similar crossbar extending between the side rails of the ladder. The partial cylindrical member is vertically oriented in use and is provided with toothed edges for engaging a tree trunk to improve stability of the ladder. While a four-point support arrangement, the device is still subject to twisting and causing a fourth point of support to disengage from the tree.

U.S. Pat. No. 4,440,263 discloses a ladder attachment that spans a distance substantially wider than the ladder to engage the side walls of a building on either side of a window or similar opening, thus preventing the ladder from engaging and damaging the window proper.

U.S. Pat. No. 4,823,911 illustrates a hook supported crossbar for supporting a scaffold on a ladder. The hook engages a ladder rung and the crossbar includes members on the ends of the crossbar to prevent the scaffold from sliding off the end of the crossbar.

None of the foregoing patents address the need to position a workman away from a utility pole, on a ladder to work safely and efficiently on equipment mounted on the utility pole while providing a stable four-point support for the ladder.

OBJECTS OF THE INVENTION

It is an object of the invention to stabilize a lineman's ladder with a four point support.

It is another object of the invention to provide a stand-off for the lineman's ladder to thereby space the ladder from the utility pole or other stable structure.

It is a further object of the invention to enable a workman on a lineman's ladder to assume working position within convenient reach of equipment within an enclosure mounted on a utility pole at approximately the level of the messenger cable.

SUMMARY OF THE INVENTION

The shortcomings of the prior art are overcome and the objects of the invention are carried out by a lineman's ladder stabilizer and support which mounts on a utility pole. The mount for the stabilizer is a sheet metal member formed in a compound "U"-channel shape. The primary U-channel has a bottom segment which is further formed to create a secondary channel. The secondary channel is shaped in a truncated wedge shape to accept a portion of a utility pole and engage the utility pole with the edges of the secondary channel. The side walls of the primary channel extend outwardly from the pole to support an electrical equipment cabinet or enclosure. The mount itself is rigidly bolted to the utility pole at the desired elevation.

The mount may be used to attach the stabilizer to the wall of a building, a tower, trestle or pole of various materials.

Extending from the mount, outwardly and preferably downwardly, is a projecting support arm. At a distal end of the projecting support arm is a horizontally disposed rigid cross-member. The cross-member is thus displaced from the utility pole. The cross-member is equipped with flange plates of a larger dimension than the diameter of the cross-member attached to the ends of the cross-member and these plates are too large to pass through the hooks of a lineman's ladder.

The cross-member is of substantial, rigid strength to support the lineman's ladder spaced apart from the utility pole. The cross-member is engageable by the hooks of the lineman's ladder. The flange plates on the end of the cross-member prevents the hooks from sliding off the cross-member, stabilizing the ladder.

A more complete understanding of the invention may be had from the attached drawings and the Detailed Description of the Invention to follow.

A DETAILED DESCRIPTION OF THE BEST MODE

OF THE PREFERRED EMBODIMENT OF THE INVENTION AS CONTEMPLATED BY THE INVENTORS

Figure 3:
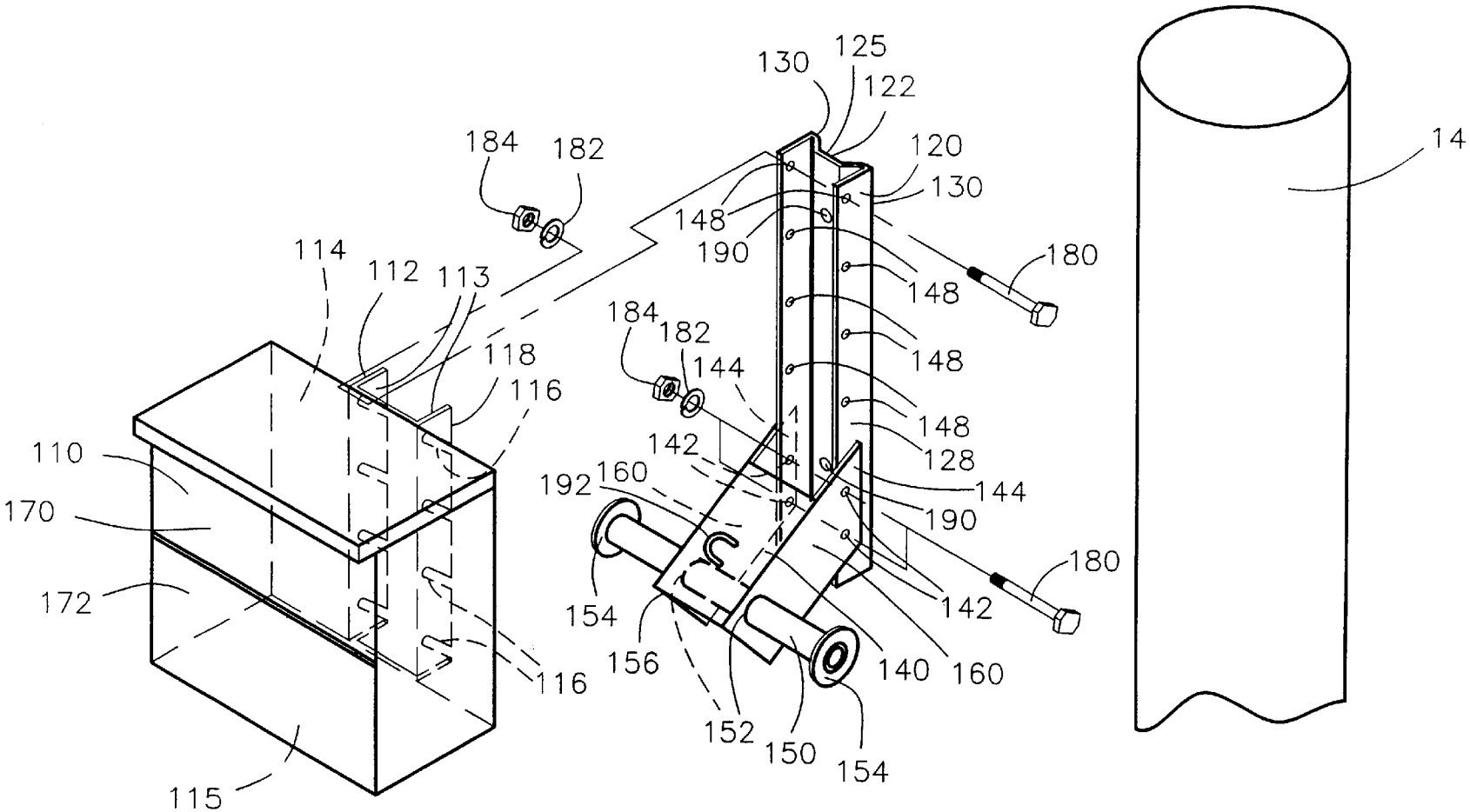
FIG. 3 is an exploded perspective view of the invention's pole bracket and support along with an electrical equipment cabinet mountable on the pole bracket.

For purposes of the description of the present invention, refer initially to FIG. 3. FIG. 3 is a partially exploded perspective view of this invention shown with an electrical equipment cabinet installable on a pole bracket.

Electrical equipment cabinet 110 is any conventional cabinet or cabinet presently used for the installation of electrical equipment associated with cable television networks or for electrical equipment used in telephone networks. Electrical equipment cabinet 110 is mountable on utility poles and is generally mounted in a permanent fashion, although cabinet 110 may be removed if necessary by disconnecting the electrical equipment therein and removing the cabinet 110 from its mount 120 or pole bracket 120. Electrical equipment cabinet 110 is provided with a formed sheet metal channel 112 attached to the back side of cabinet 110. Channel 112 is generally U-shaped with its side walls 113 projecting away from the back side 114 of electrical equipment cabinet 110. Sheet metal channel 112 is further supported by support and fastening channels 116 cut into the side walls 113. Channels 116 are oriented such that they extend from the edge 118 of sheet metal channel's 112 side walls 113 upwardly and toward cabinet 110 at an angle as illustrated. This angular orientation will insure that the weight of the electrical equipment cabinet 110 acts to further engage the channel 112 with its support to be described below.

Pole bracket 120 is similarly formed into a channel shape. The U-channel shape of pole bracket 120 is further formed into a compound channel such that the U-shape of channel 120 is formed with the bottom span 122 of the U-shaped channel 120 forming a shallow concave channel surface 125. The depth of the channel 125 is sufficient to permit the engagement along the entire length of edges 130 of pole bracket 120 with utility pole 124. The edges 130 of pole bracket 120 serve as the primary contact surfaces between utility pole 14 and pole bracket 120.

Pole bracket 120 is bolted to utility pole 14 at a convenient height considering the elevation of any cabling associated with electrical equipment cabinet 110. The pole bracket 120, although primarily fabricated to be attached to a utility pole, usually wood, concrete or metal, but may be used in its unaltered form on walls, towers, trestles or other structures that present a member or surface to which pole bracket 120 may be bolted or attached. When the supporting structure is a metal, such as steel, the pole bracket may be permanently mounted by welding if desired.

Attached at the bottom end of the pole bracket 120, extending away from utility pole 14, is a projecting support arm 140. Projecting support arm 140 may be bolted through holes 142 to pole bracket 120. Alternatively, projecting support arm 140 and pole bracket 120 may be welded together.

Preferably, projecting support arm 140 may be fabricated from sheet metal by cutting to the appropriate shape and bending the metal to form a partial, tubular structure with a generally rectangular cross-section. It has been found that fabricated sheet metal provides sufficient strength and it is generally not necessary to utilize a complete, heavy gauge rectangular tubing. Should rectangular tubing be desired for extraordinary loads, the end of the rectangular tubing may be cut and fabricated to a shape which permits engagement with and attachment to pole bracket 120 in the desired location.

With the preferred fabrication of projecting arm 140, tab members 144 on the end of projecting arm 140 are fabricated to engage pole bracket 120. Bolt holes 142 are formed in the tab members 144 in a pattern aligned with similar bolt holes in an appropriate bolt pattern in a lower end of side walls 128 of pole bracket 120.

Figure 1:
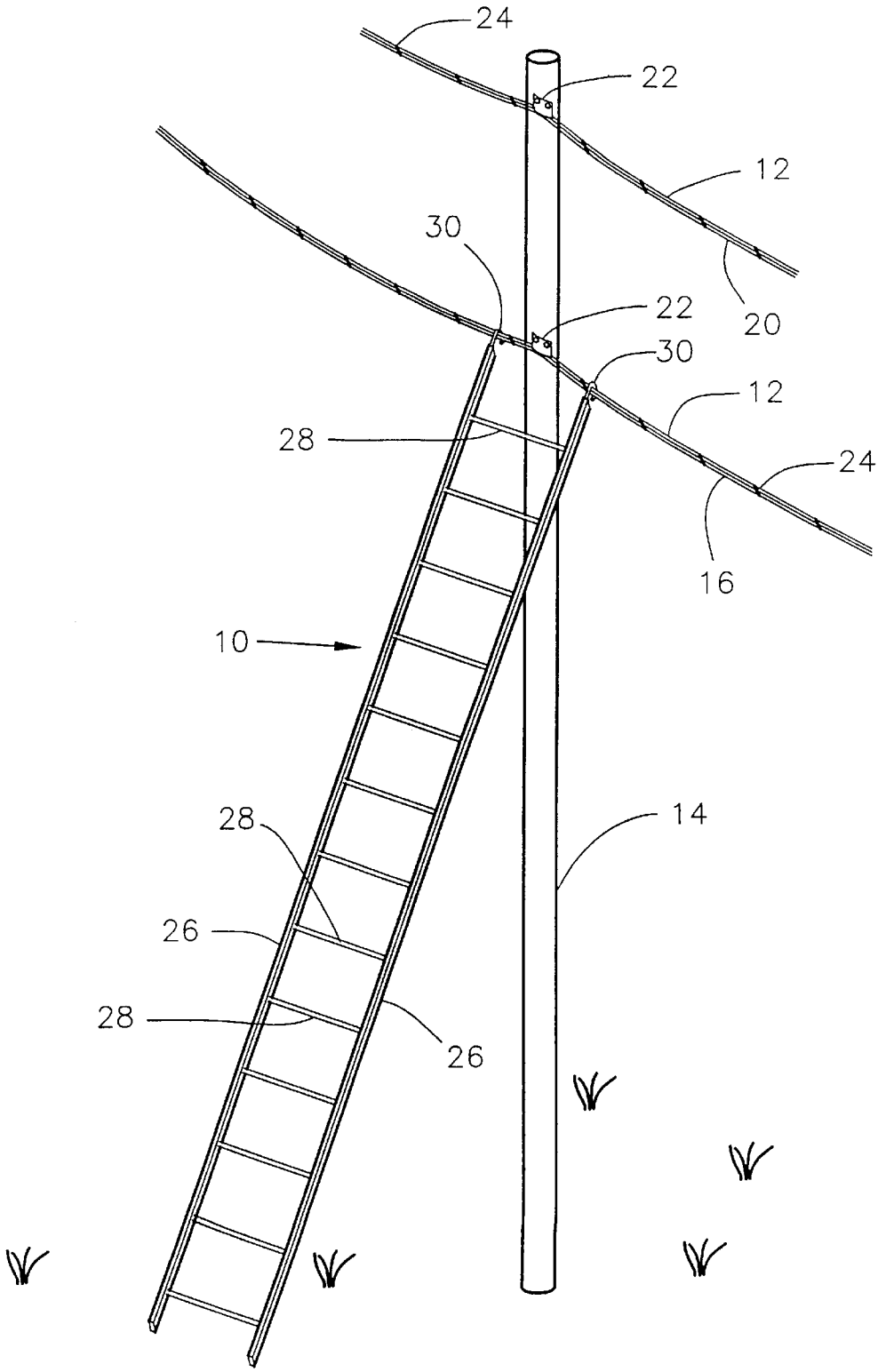
FIG. 1 PRIOR ART
FIG. 1 is an illustration of a lineman's ladder engaged with and supported by a messenger cable supported on a utility pole as typically used in the prior art.
Figure 2:
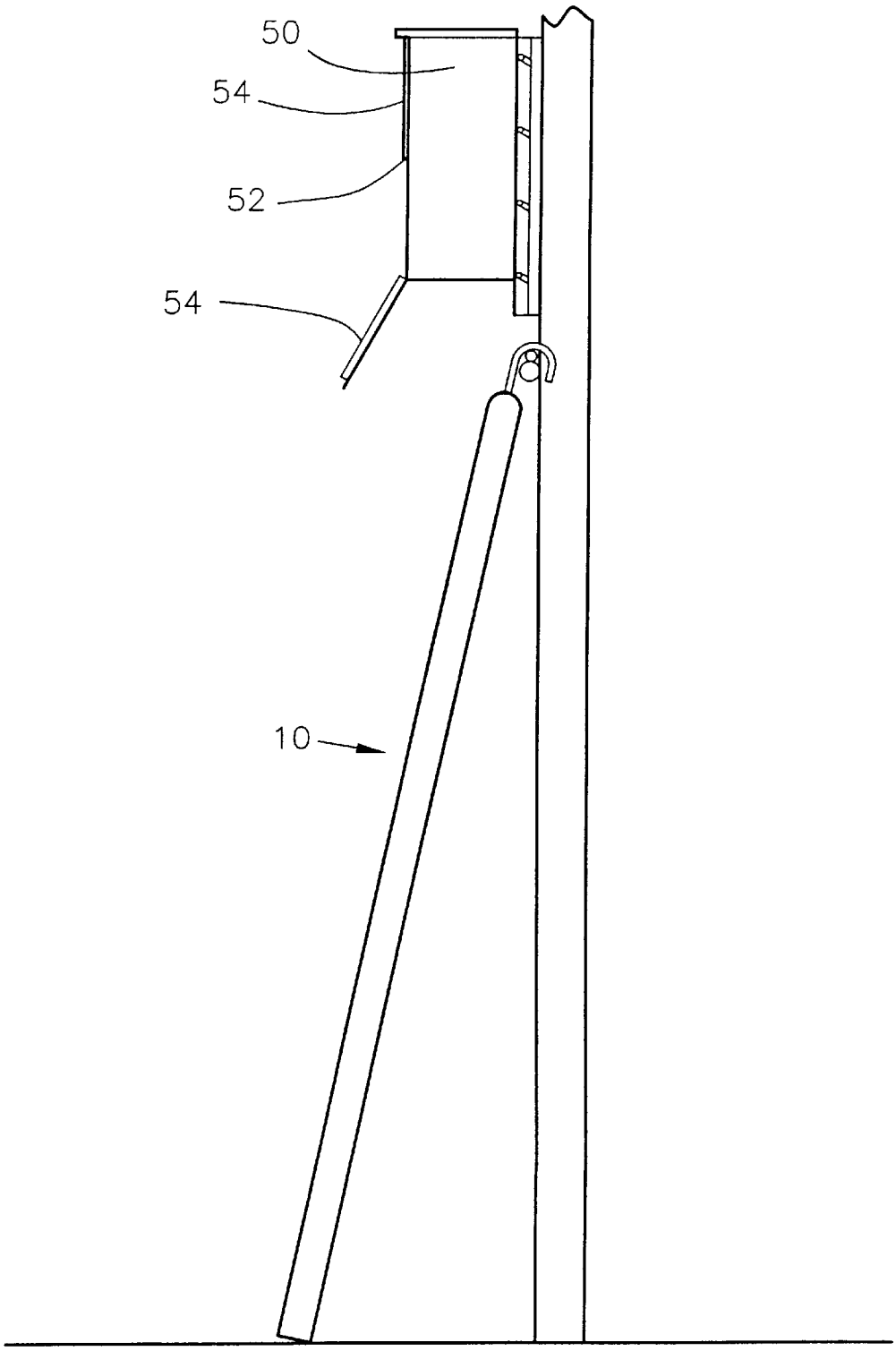
FIG. 2 PRIOR ART
FIG. 2 illustrates a utility pole mounted electrical equipment cabinet with a lineman's ladder supported by the messenger cable which, in turn, is supported by the utility pole as typically used in the prior art.

Near the projecting distal end 156 of projecting arm 140, a pair of holes 152 are formed in its side walls 160. A supporting cross-arm 150 is disposed in holes 152 with an approximately equal length of the cross-arm 150 extending beyond side walls 160 of the projecting arm 140. The overall length of the cross-arm should be at least slightly longer than the overall outside dimension from hook 30 to hook 30 of a lineman's ladder 10, as can be seen in FIG. 1.

The ends of cross-arm member 150 are provided with enlarged flanges or flange plates 154. Flanges 154 may be circular while flange plates 154 may be square or other shape. Both flanges and flange plates are referred to as flanges 154.

Figure 4:
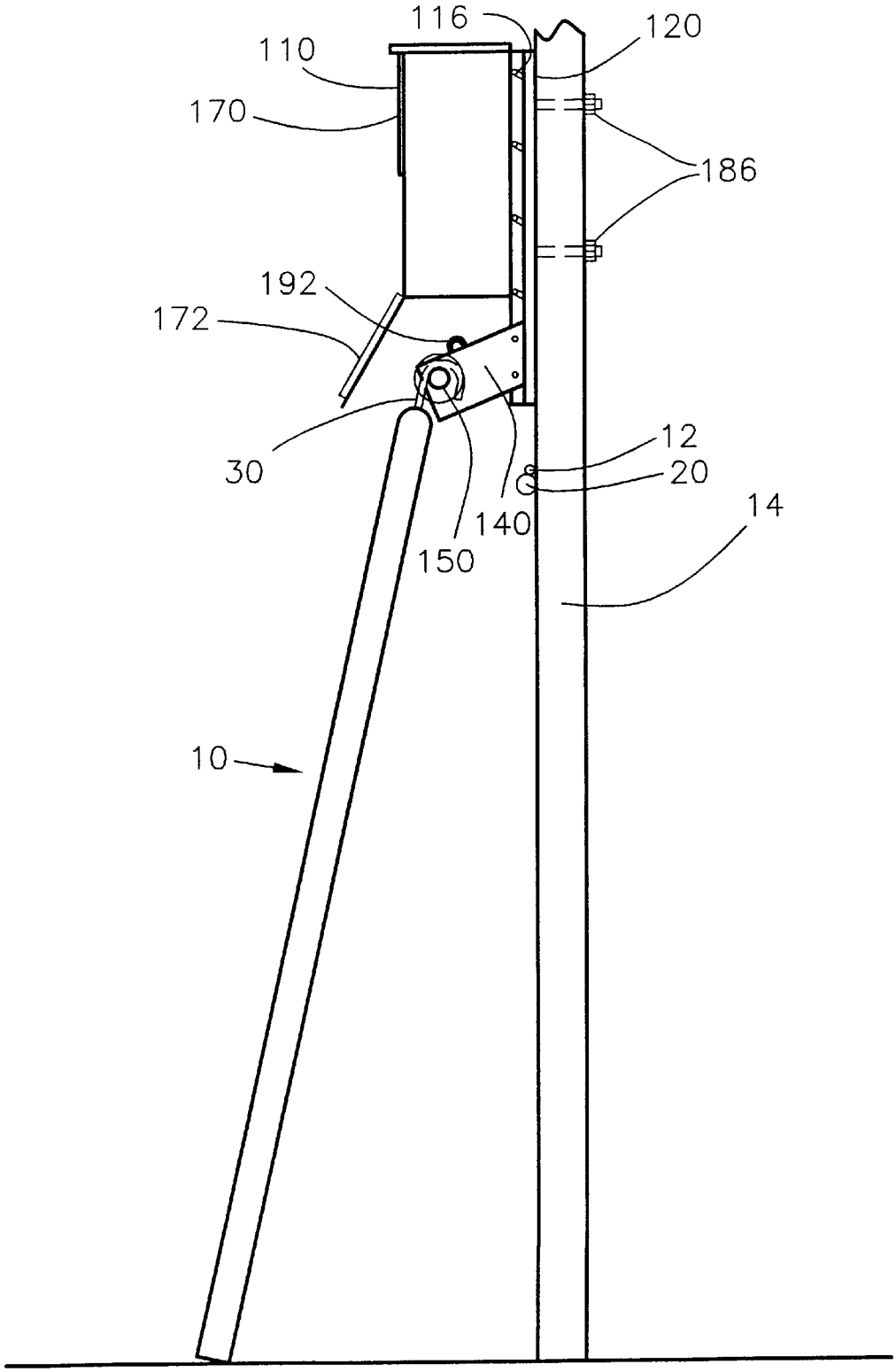
FIG. 4 illustrates a side view of the invention supported on the pole bracket beneath an electrical equipment cabinet which, in turn, is supported on a utility pole.

Flanges 154 are permanently attached to cross-arm member 150 by any convenient means. The preferred means of attaching flanges 154 to cross-arm member 150 is by welding, but any suitable attaching technique may be used, such as a bolt extending through cross-arm member 150 on flanges 154. The size of the flanges 154 should be large enough to prevent their passage through the hook 30 of lineman's ladder 10, as shown in FIG. 4.

Similarly, cross-arm 150 is permanently and rigidly attached to the projecting support arm 140 at their junctions by welding or other suitable attaching technique such that cross-arm 150 cannot shift relative to projecting arm 140.

The length of projecting arm 140 is preferably approximately the same as the front-to-back or depth dimension of electrical equipment cabinet 110. Additionally, projecting arm 140 is preferably oriented such that it projects outwardly from pole bracket 120 and downward slightly such that the distal end 156 of projecting arm 140 is disposed below the floor 115 of electrical equipment cabinet 110 by a distance equal to approximately one-third to one-half of the projecting arm's 140 length. This provides clearance between cabinet 110 and cross-arm 150 to pass hooks 30 of lineman's ladder 10 whenever engaging or disengaging the hooks 30 from cross-arm 150.

Electrical equipment cabinet 110 is preferably and typically provided with front access through upwardly swinging door 170 and downwardly swinging door 172.

Pole bracket 120 additionally is provided with a plurality of holes 148 near the edge of the side walls 128 of pole bracket 120. Walls 128 and particularly holes 148 will accept bolt 180. Once bolt 180 has been inserted through hole 148, washer 182 and nut 184 may be installed on bolt 180 and electrical equipment cabinet 110 may be hung on bolt 180 by utilizing channels 116 in U-channel 112. Only one bolt 180 and the associated washer 182 and nut 184 are illustrated; nevertheless, it should be understood that typically each of the holes 148 would contain such a bolt assembly.

An additional plurality of holes 190 are formed in U-shaped channel 122 to accept bolts, such as bolts 186 as illustrated in FIG. 4, in order to bolt pole bracket 120 to pole 14.

Making reference now to FIG. 4, the arrangement of the assembled invention together with a utility pole 14 and lineman's ladder 10 is illustrated in a side view. Utility pole 14 is illustrated with pole bracket 120 bolted thereon with bolts 186 to attach pole bracket 120 to utility pole 14. Pole bracket 120 supports projecting arm 140 as described previously with reference to FIG. 3. Electrical equipment cabinet 110 is illustrated as hung on and installed onto pole bracket 120 with channels 116.

Lineman's ladder 10 is illustrated with hooks 30 on the upper end of the ladder 10 engaged with cross-arm member 150 of projecting arm 140. As can be clearly seen, the upper end of ladder 10 is disposed approximately directly below the front face of electrical equipment cabinet 110. The lineman's ladder 10 is thus supported on two points at the base of the ladder and two points at the top of the ladder. This four-point support will substantially increase the stability of the ladder 10 over a three-point support. Once the lineman ascends the lineman's ladder 10, his position will be such that his feet are several rungs below the top, the front panels 170 and 172 may be swung open, and the equipment contained within the electrical equipment cabinet 110 will be at approximately chest height or slightly higher, thus affording a comfortable working position for the lineman.

The projecting arm 140 with cross-member 150 supported by pole bracket 120 substantially enhances the stability of the lineman's ladder 10 and the safety of any workman using the ladder 10.

Projecting arm 140 further is provided with a shackle or "U" bolt 192 attached to project upwardly. "U" bolt 192 provides a convenient attachment point for a lineman's safety belt worn by all linemen.

It will be understood to one of skill in the art that the length of projecting arm 140 will be dependent to some extent upon the front-to-back dimension of electrical equipment cabinet 110. It should also be recognized that electrical equipment cabinet 110 does not need to be installed; the pole bracket 120, projecting arm member 140 and cross-arm member 150 may be installed independently from electrical equipment cabinet 110 as an assembly. They provide the same benefits of stabilizing a ladder and increasing the safety of a worker should the need arise to access a particular spot on or piece of equipment mounted directly to the utility pole 14.

As one of skill in the art fully understands the invention and its several advantages, benefits and utility, alternative embodiments come to mind. Alternatives in the design could include a longer cross-arm support member 150 without end flanges, or the projecting arm could be fashioned as a bifurcated member having two projecting arms of portions thereof, supporting cross-arm support member 150 between them. Also, discrete electrical devices that do not require enclosure within an electrical equipment cabinet may be provided a channel mount and attached to the pole bracket; the ladder stabilizer provides a stable and safe manner to support a lineman's ladder in order to access the mounted device. One of skill in the art will also readily recognize the broader use of the invention not only in the telecommunications and cable television fields but also its potential in the electrical power utility field as well.

It should be recognized that other minor modifications and changes may be made in the design of the subject invention while still providing the functions, benefits and advantages of the invention without departing from the scope of the claims attached hereto.

We claim:

1. An electronic equipment container and ladder stabilizer assembly comprising:

a means for containing electronic equipment, a means for mounting said means for containing on a utility pole;

said means for containing comprising a means for accessing an interior portion disposed substantially vertically on a front of said means for containing;

a means for supporting on a rear of said means for containing, and supporting said means for containing on said means for mounting;

said means for mounting further comprising a ladder support means disposed to position an elevated end of said ladder proximate a plane defined by said means for accessing said interior portion, said ladder support means having a projecting member projecting away form said means for mounting and below said means for containing and having a means for engaging said ladder disposed horizontally transverse to said projecting member at an outer free end thereof, whereby said ladder may be stabilized by said means for engaging said ladder to position said ladder from said pole by a distance sufficient to provide stable access from said ladder to space within said means for containing electronic equipment.

2. The electronic equipment container and ladder stabilizer assembly of claim 1 wherein said means for supporting further comprises flanges for mating with said means for mounting, said flanges and said means for mounting having openings for accepting said means for supporting, said means for supporting comprising fasteners for attaching said flanges to said means for mounting and supporting said flanges relative to said means for mounting.

3. The electronic equipment container and ladder stabilizer assembly of claim 1 further comprising attachment means, supported by said means for mounting, for receiving attachment of a lineman's safety belt.

4. The electronic equipment container and ladder stabilizer assembly of claim 3 wherein said attachment means is supported by said ladder support means.

5. An electronic equipment container and ladder stabilizer assembly comprising:

an engaging member for attachment to a utility pole;

a flanged member engaging said engaging member with flanges projecting toward and disposable juxtaposed with surfaces of said engaging member, said flanged member and said engaging member each attachable to the other;

said flanged member supporting an electronic equipment container disposed on a rear of said container;

said container comprising an access opening on a front thereof, and said engaging member further supporting a standoff member extending from said engaging member forwardly and below said container, said standoff member further comprising a ladder stabilizing member extending transverse to said standoff member and proximate a forward end thereof, whereby said stabilizing member may be engaged by a ladder for positioning said ladder such that a workman on said ladder is conveniently located adjacent said access opening.

6. The electronic equipment container and ladder stabilizer assembly of claim 5 wherein said standoff member extends from said engaging member below said container and said ladder stabilizing member is disposed parallel said access opening.

7. The electronic equipment container and ladder stabilizer assembly of claim 6 wherein said standoff member further comprises an attachment member for receiving attachment of a lineman's safety belt.

8. The electronic equipment container and ladder stabilizer assembly of claim 7 wherein said attachment member is supported by said ladder support member.

9. The electronic equipment container and ladder stabilizer assembly of claim 7 wherein said ladder support member further comprises flanges disposed proximate ends of said ladder support member for preventing said ladder from slipping from said ladder support member.

10. The electronic equipment container and ladder stabilizer assembly of claim 6 wherein said standoff member extends downward and away from said container.

11. An electronic equipment container and ladder stabilizer assembly comprising:

a container having an access opening for containing electronic equipment on a front thereof to be supported by a utility pole;

a mounting bracket attachable to said utility pole;

a rear of said container attached to said mounting bracket;

said mounting bracket further comprising a standoff member extending outwardly from said mounting bracket toward the front of said container and below said container and a ladder stabilizing member disposed proximate to an extended end of said standoff member and transverse to said standoff member, whereby said ladder may be engaged with said ladder stabilizing member and be positioned to further position a workman in a convenient location for accessing and working within said container without being subjected to a precarious position relative to said container and said access opening.

12. The electronic equipment container and ladder stabilizer assembly of claim 11 wherein said ladder stabilizing member is further horizontally disposed.

13. The electronic equipment container and ladder stabilizer assembly of claim 12 wherein said ladder stabilizing member further comprises extending members extending from said ladder stabilizing member for preventing said ladder from slipping laterally from said member.

14. The electronic equipment container and ladder stabilizer assembly of claim 12 wherein said mounting bracket further comprises at least an opening for being engaged by a safety device.

15. The electronic equipment container and ladder stabilizer assembly of claim 14 wherein said opening is attached to said standoff member.

16. The electronic equipment container and ladder stabilizer assembly of claim 13 wherein said extending members comprise projections extending from said ladder stabilizing member and disposed in a plane transverse to a longitudinal axis of said ladder stabilizing member.

* * * * *